US006179578B1

(12) United States Patent
Kayukawa et al.

(10) Patent No.: US 6,179,578 B1
(45) Date of Patent: Jan. 30, 2001

(54) COMPRESSOR WITH OIL SEPARATING STRUCTURE

(75) Inventors: Hiroaki Kayukawa; Shigeyuki Hidaka; Suguru Hirota; Kenta Nakauchi, all of Kariya (JP)

(73) Assignee: Kabushiki Kaisha Toyoda Jidishokki Seisakusho, Kariya (JP)

( * ) Notice: Under 35 U.S.C. 154(b), the term of this patent shall be extended for 0 days.

(21) Appl. No.: 09/330,650

(22) Filed: Jun. 11, 1999

(30) Foreign Application Priority Data

Jun. 15, 1998 (JP) ..... 10-167109

(51) Int. Cl.[7] ..... F04B 23/00; F04B 1/12
(52) U.S. Cl. ..... 417/313; 417/269
(58) Field of Search ..... 417/222.2, 269, 417/313, 372; 62/470, 55.5; 92/154; 96/55

(56) References Cited

U.S. PATENT DOCUMENTS 3,801,227 * 4/1974 Nakayama ..... 417/269
4,229,145 * 10/1980 Isizuka ..... 417/269
5,636,974 * 6/1997 Ikeda et al. ..... 417/269
6,010,314 * 1/2000 Kobayashi et al. ..... 417/222.2

FOREIGN PATENT DOCUMENTS 8-035485 2/1996 (JP) .
10-281060 10/1998 (JP) .

* cited by examiner

*Primary Examiner*—Teresa Walberg
*Assistant Examiner*—Daniel Robinson
(74) *Attorney, Agent, or Firm*—Morgan & Finnegan, L.L.P.

(57) ABSTRACT

A compressor includes a compressing mechanism for compressing refrigerant gas and an oil separator for separating the oil from the gas. The separated oil is used to lubricate the compressor. The compressor has a discharge passage to permit refrigerant gas to flow out of the compressor, a recess located in the discharge passage, a plug press fitted in the recess and a supply passage for returning the separated oil to the compressor. The plug and the recess define a separation chamber having a circular cross-section and an annular chamber. The separation chamber is connected with the annular chamber by an outlet passage formed in the plug. The refrigerant gas swirls along the wall of the separation chamber, which separates the oil from the gas. Since the plug is press fitted in the recess, installation of the plug is facilitated. This structure also prevents the plug from loosening.

29 Claims, 4 Drawing Sheets

COMPRESSOR WITH OIL SEPARATING STRUCTURE

BACKGROUND OF THE INVENTION

The present invention relates to a compressor. More specifically, the present invention pertains to oil separating structures for compressors that are used in vehicle air conditioners to separate atomized lubricant in refrigerant gas.

Refrigerant gas in a compressor is compressed and circulated between the compressor and an external circuit to carry heat. Some compressors include an oil separating structure for collecting atomized oil. The collected oil is used for lubricating parts of the compressor. FIGS. 5(*a*) and 5(*b*) show such an oil separating structure. The compressor of FIGS. 5(*a*) and 5(*b*) includes a housing 101. The housing 101 accommodates a compressing mechanism (not shown). A discharge passage 102 is formed in the housing 101 to conduct refrigerant from the compressing mechanism to an external refrigerant circuit. A recess 103 is defined in the housing 101 and located in the discharge passage 102. The recess 103 has a circular cross-section and extends in the axial direction of the compressor. A plug 104 includes a first flange 105, second flange 106 and a cylinder 107, which connects the flanges 105, 106. The plug 104 is inserted into the recess 103 from the left, as viewed in FIG. 5(*a*). Specifically, the plug 104 is press fitted in the recess 103 such that the first flange 105 contacts a positioning step 103*b* defined on the inner wall 103*a* of the recess 103.

An annular groove 103*c* is formed in the wall of the recess 103 at the open end. A snap ring 108 is engaged with the annular groove 103*c*. Specifically, the peripheral portion 108*a* of the snap ring 108 is fitted in the groove 103*c*. The cross section of the snap ring 108 is tapered such that its axial dimension decreases toward the periphery. The plug 104 is held between the snap ring 108 and the step 103*b*. The snap ring 108 prevents the plug 104 from disengaging from the recess 103.

Dimensional errors may vary the distance d between the groove 103*c* and the step 103*b*. However, the plug 104 is still securely held between the snap ring 108 and the step 103*b*, since the radial penetration of the peripheral portion 108*a* in the groove 103*c* can vary. This permits variation in the axial location of the plug 104. In FIG. 5(*b*), a solid line shows the position of the snap ring 108 when the distance d is shorter than the axial dimension h of the plug 104. A broken line shows the position of the snap ring 108 when the distance d is substantially the same as the axial dimension h of the plug 104.

As shown in FIG. 5(*a*), a separation chamber 109 is defined at the right side of the plug 104 by the first flange 105. Also, the first and second flanges 105, 106 define the ends of an annular chamber 110. An outlet passage 111 is formed in the first flange 105 and the cylinder 107 to connect the separation chamber 109 with the annular chamber 110. The separation chamber 109 is exposed to the discharge pressure of the compressor. The separation chamber 109 is connected to a low pressure zone by an oil return passage 112 formed in the housing 101. The low pressure zone is an area where the pressure is lower than the discharge pressure.

Refrigerant gas is discharged to the external circuit from the compressor via the discharge passage 102. Before being discharged, the gas flows along the inner wall 103*a* of the separation chamber 109. Centrifugal force separates atomized lubricant from the gas. The gas is then discharged to the external circuit via the outlet passage 111 and the annular chamber 110. Due to the pressure difference between the separation chamber 109 and the low pressure zone, the separated oil is returned to the low pressure zone via the return passage 112. The oil is then supplied to parts in the compressor to lubricate and cool the parts.

However, due to machining errors, the distance d between the groove 103*c* and the step 103*b* can be far shorter than the axial dimension h of the plug 104. In this case, the snap ring 108 cannot be fitted in the groove 103*c*.

Further, if the distance d is greater than the axial dimension h, the plug 104 will not be firmly held between the snap ring 108 and the step 103*b*. In this case, the plug 104 can be rotated along with the flow of refrigerant gas in the separation chamber 109, which causes the circumferential surfaces 105*a*, 106*a* of the first and second flanges 105, 106 to slide on the inner surface 103*a* of the recess 103, which wears the plug 104. Also, if loosely held, the plug 104 chatters in the recess 103, which produces vibration and noise.

To solve this problem, the plug 104 is selected from plugs having different axial dimensions. When assembling the plug 104 in the chamber 103, the distance d between the groove 103*c* and the step 103*b* is measured, and a plug 104 having a corresponding axial dimension is selected. In this manner, dimensional errors due to machining accuracy are accommodated by the snap ring 108. Therefore, the assembly of the plug 104 into the recess 103 is complicated.

SUMMARY OF THE INVENTION

Accordingly, it is an objective of the present invention to provide an oil separating structure for compressors that facilitates the installation of a plug in a recess.

To achieve the foregoing and other objectives and in accordance with the purpose of the present invention, a compressor is provided. The compressor includes a housing, a compressing mechanism, a discharge passage and an oil separator. The compressing mechanism is housed by the housing, for compressing refrigerant gas. Lubricating oil is mixed in the gas. The discharge passage permits refrigerant to flow out of the compressor. The oil separator separates the lubricating oil from the gas. The separator includes a recess, a plug and a supply passage. The plug is securely press-fitted in the recess. The plug and the recess form a separation chamber located in the flow passage. The plug includes an outlet passage leading downstream from the separation chamber. The refrigerant gas enters the separation chamber, flows along the wall of the separation chamber and exits from the separation chamber, which separates the oil from the gas. The supply passage connects the separation chamber to the compressing mechanism to supply lubricant to the compressing mechanism.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 4(*b*) is a side view illustrating a method for coating a layer on the plug of FIG. 2;

FIG. 4(*c*) is an enlargement of the portion of FIG. 4(*b*) encircled by a line;

FIG. 4(*d*) is a cross-sectional view illustrating a method for installing the plug of FIG. 4(*a*) to a recess;

FIG. 5(*b*) is an enlarged partial cross-sectional view illustrating the prior art snap ring of FIG. 5(*a*).

DETAILED DESCRIPTION OF THE PREFERRED EMBODIMENTS

An oil separating structure according to one embodiment will now be described. The mechanism is used in variable displacement compressors for vehicle air conditioners.

The construction of the compressor will first be described.

Figure 1:
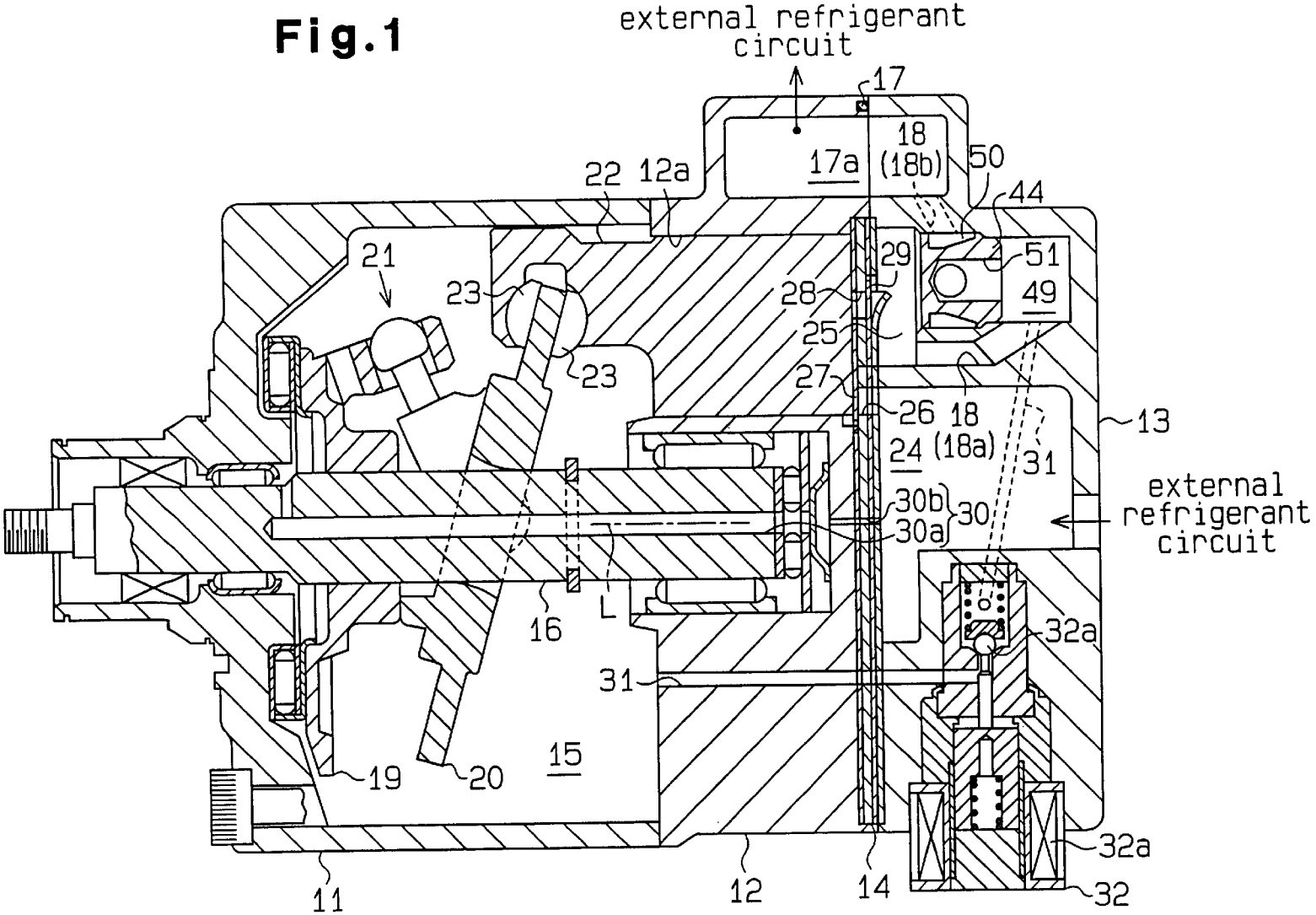
FIG. 1 is a cross-sectional view illustrating a variable displacement compressor according to one embodiment of the present invention.

As shown in FIG. 1, a front housing 11 is secured to the front end face of a cylinder block 12. A rear housing 13 is secured to the rear end face of the cylinder block 12. A valve plate 14 is located between the rear housing 13 and the rear end face. A crank chamber 15 is defined by the inner walls of the front housing 11 and the front end face of the cylinder block 12. The front housing 11, the cylinder block 12 and the rear housing 13 are made of aluminum or aluminum alloy and constitute the compressor housing. Compared to a compressor housing made of iron alloy, a compressor housing made of aluminum or aluminum alloy reduces the weight of the compressor.

A drive shaft 16 extends through the crank chamber 15 and is rotatably supported by the front housing 11 and the cylinder block 12. The drive shaft 16 is operably coupled to an engine by an electromagnetic clutch (not shown). When the engine is running, the clutch selectively transmits the drive power of the engine to the drive shaft 16.

A lug plate 19 is fixed to the drive shaft 16 in the crank chamber 15. A swash plate 20 is supported by the drive shaft 16 in the crank chamber 15 to slide along the surface of and to tilt with respect to the axis of the shaft 16. Part of the lug plate 19 and part of the swash plate 20 constitute a hinge mechanism 21. The hinge mechanism 21 permits the swash plate 20 to incline with respect to the drive shaft 16 and to rotate integrally with the drive shaft 16. When the central portion of the swash plate 20 moves toward the cylinder block 12, the inclination of the swash plate 20 decreases. When the central portion of the swash plate 20 moves toward the lug plate 19, the inclination of the swash plate 20 increases.

Cylinder bores 12*a* are formed in the cylinder block 12. Each cylinder bore 12*a* houses a single-headed piston 22. Specifically, one end of each piston 22 is located in the associated cylinder bore 12*a* and the other end of the piston 22 is coupled to the periphery of the swash plate 20 by shoes 23. The pistons 22 are reciprocated in the cylinder bores 12*a* by rotation of the swash plate 20.

A suction chamber 24 and a discharge chamber 25 are defined in the rear housing 13. Suction ports 26, suction valve flaps 27, discharge ports 28 and discharge valve flaps 29 are formed in the valve plate 14. Refrigerant gas is drawn to the suction chamber 24 from the external refrigerant circuit. Then, as each piston 22 moves from the top dead center to the bottom dead center in the associated cylinder bore 12*a*, refrigerant gas in the suction chamber 24 is drawn into the cylinder bore 12*a* through the associated suction port 26 and the associated suction valve flap 27. As the piston 22 moves from the bottom dead center to the top dead center in the cylinder bore 12*a*, the gas in the cylinder bore 12*a* is compressed to a predetermined pressure. The gas is then discharged to the discharge chamber 25 through the associated discharge port 28 and the associated valve flap 29.

An expansion muffler 17 is formed to straddle the cylinder block 12 and the rear housing 13. A muffler chamber 17*a* is defined in the muffler 17. The muffler chamber 17*a* is connected to an external refrigerant circuit. A discharge passage 18 is formed in the rear housing 13 to connect the discharge chamber 25 with the muffler chamber 17*a*. Refrigerant gas in the discharge chamber 25 is discharged to the external circuit via the discharge passage 18 and the muffler chamber 17*a*. The muffler 17 suppresses pressure pulsation of the refrigerant gas.

A bleeding passage 30 includes a passage 30*a* formed in the drive shaft 16 along its axis and a passage 30*b* formed in the cylinder block 12 and the valve plate 14. The bleeding passage 30 connects the crank chamber 15 with the suction chamber 24. A supply passage 31 connects a discharge pressure zone (a separation chamber 49, which will be described later) with the crank chamber 15, which is a low pressure zone. The pressure of the low pressure zone is lower than the discharge pressure.

A displacement control valve 32 is accommodated in the rear housing 13 to regulate the supply passage 31. The control valve 32 is an electromagnetic valve and includes a solenoid 32*a* and a valve body 32*b*. Excitation and de-excitation of the solenoid 32*a* causes the valve body 32*b* to open and close the supply passage 31. The control valve 32 is connected to a computer (not shown). The computer excites and de-excites the solenoid 32*a* to move the valve body 32*b* in accordance with the need for air conditioning. Accordingly, the control valve 32 regulates the flow of refrigerant gas from the discharge chamber 25 to the crank chamber 15, which controls the difference between the pressure of the crank chamber 15 and the pressure of the cylinder bores 12*a*. That is, the control valve 32 changes the difference between the pressures acting on the front and rear ends of each piston 22. The inclination of the swash plate 20 is altered in accordance with changes in the pressure difference. This alters the stroke of the pistons 22 and varies the displacement of the compressor.

When de-excited, the solenoid 32*a* causes the valve body 32*b* to open the supply passage 31, which connects the separation chamber 49 (discharge pressure zone) with the crank chamber 15. Accordingly, the highly pressurized gas in the chamber 49 is supplied to the crank chamber 15 through the supply passage 31, which increases pressure of the crank chamber 15. An increase in the crank chamber pressure minimizes the inclination of the swash plate 20. This shortens the stroke of each piston 22 and decreases the displacement of the compressor. When excited, the solenoid 32*a* causes the valve body 32*b* to close the supply passage 31, which releases the gas of the crank chamber 15 through the bleeding passage 30 thereby lowering the pressure of the crank chamber 15. A decrease in the crank chamber pressure maximizes the inclination of the swash plate 20. This lengthens the stroke of each piston 22 and maximizes the displacement.

The oil separating structure of the above described compressor will now be described.

Figure 2:
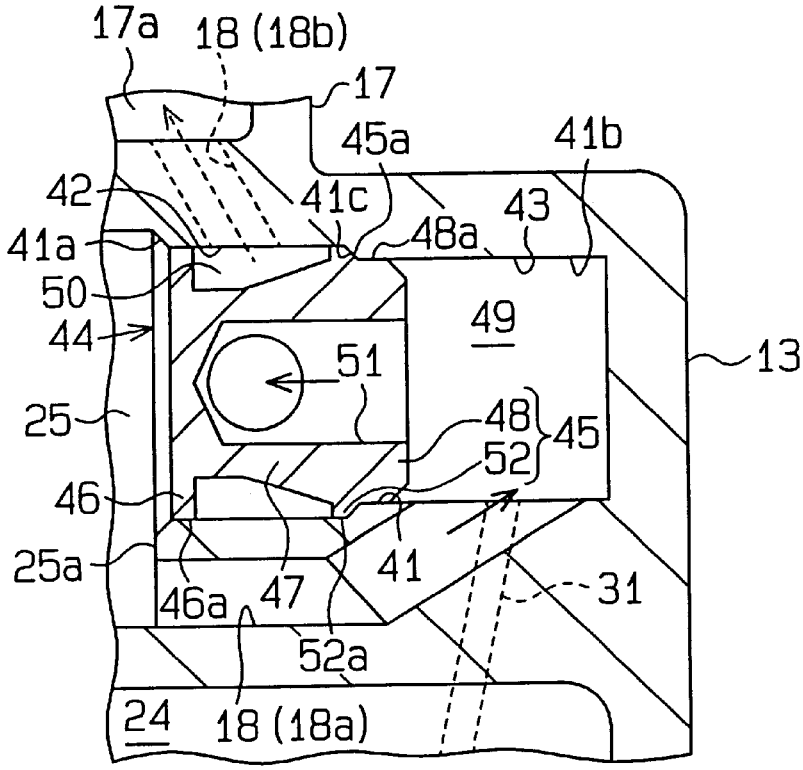
FIG. 2 is an enlarged partial cross-sectional view illustrating an oil separating structure in the compressor of FIG. 1.
Figure 3:
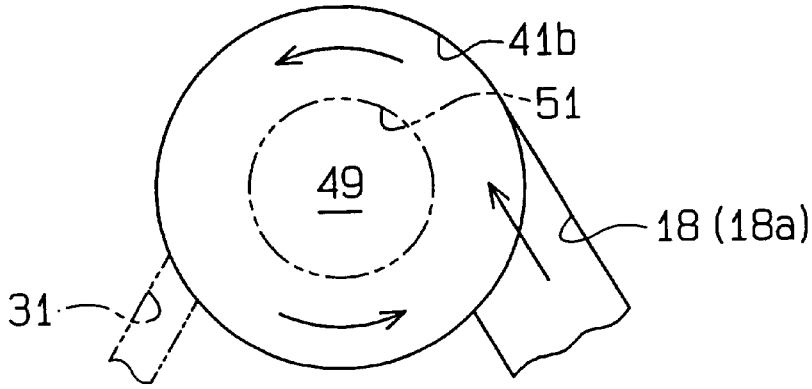
FIG. 3 is a cross-sectional view illustrating the oil chamber of FIG. 2.
Figure 4A:
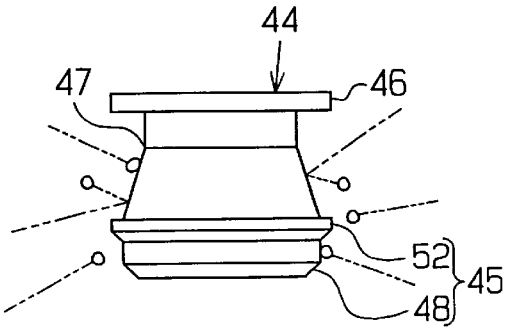
FIG. 4(*a*) is a side view illustrating a method for roughening the surface of the plug of FIG. 2.
Figure 4B:
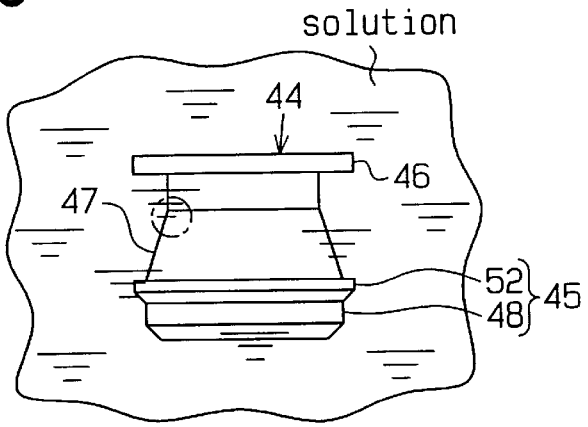
Figure 4C:
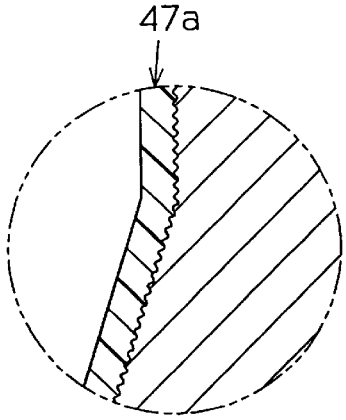
Figure 4D:
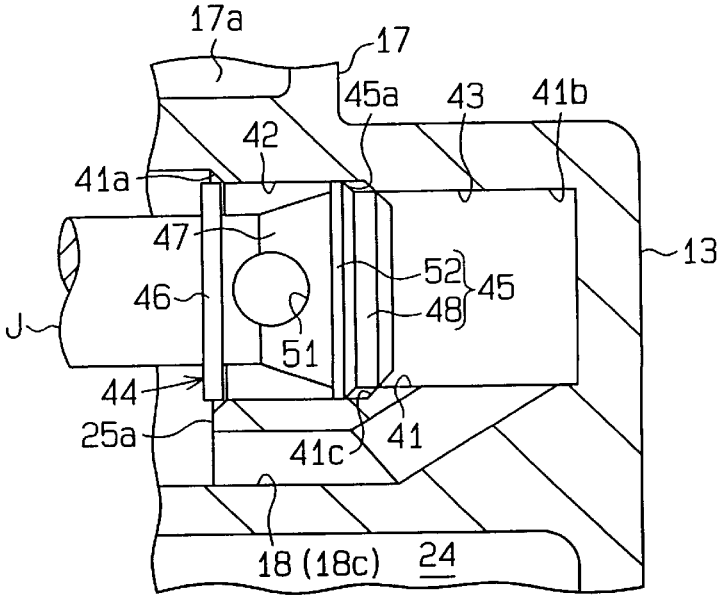
Figure 5A:
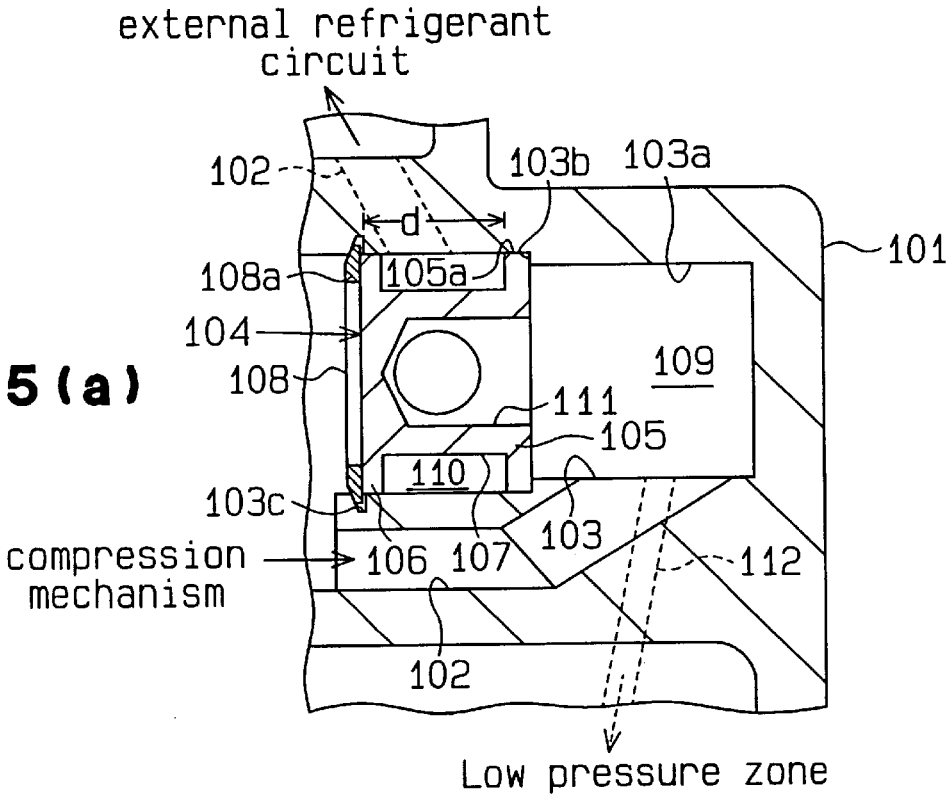
FIG. 5(*a*) is an enlarged partial cross-sectional view illustrating a prior art oil separating structure.
Figure 5B:
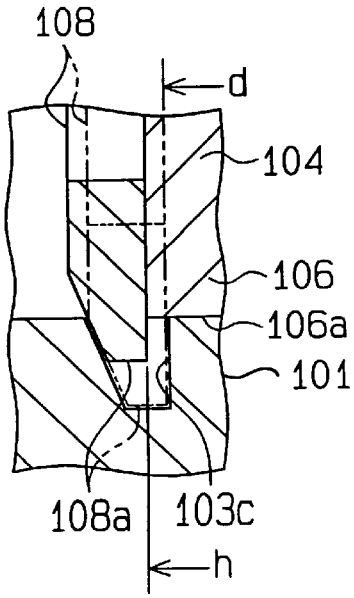

As shown in FIGS. 2 and 3, a recess 41 is formed in the discharge chamber 25 and located in the discharge passage 18. The recess 41 opens at the inner wall 25*a* of the discharge chamber 25. The open end 41*a* of the chamber 41 is tapered by chamfering. The diameter of the open end 41*a* increases toward the discharge chamber 25. The recess 41 has a circular cross-section. The inner wall 41*b* of the recess 41 includes a large diameter portion 42 adjacent to the open end 41*a* and a small diameter portion 43. A step 41*c* is defined between the large diameter portion 42 and the small diameter portion 43.

A plug 44 is made of the same material as that of the rear housing 13. That is, the plug 44 is made of aluminum or aluminum alloy. The plug 44 is made by casting or forging and includes a first flange 45, a second flange 46 and a cylinder 47, which connects the first and second flanges 45, 46. The first flange 45 includes a stopper 52 and a distal portion 48. The distal portion 48 is formed on the opposite side of the stopper 52 from the cylinder 47. The outer diameter of the stopper 52 and the outer diameter of the second flange 46 are substantially the same as that of the large diameter portion 42 of the recess 41. A step 45*a* is defined between the stopper 52 and the distal portion 48. The step 45*a* of the stopper 52 engages with the step 41*c* of the recess 41.

As illustrated in FIG. 4(*a*), the entire surface of the plug 44, which includes the circumferential surfaces 52*a*, 48*a* of the stopper 52 and the distal portion 48 and the circumferential surface 46*a* of the second flange 46, is roughened by shot blasting. FIG. 4(*a*) illustrates shots, or particles, striking the surface of the plug 44.

As shown in FIG. 4(*c*), the roughened surface of the plug 44 is coated with a solid lubricant coating 47*a*. The coating 47*a* is formed by immersion coating. That is, the plug 44 is immersed in a solution in which the solid lubricant is dissolved. Then, the plug 44 is dried to remove the solution, which forms the coating of solid lubricant. The solid lubricant includes fluorocarbon resin such as molybdenum disulfide and polytetrafluoroethylene.

As shown in FIG. 4(*d*), the coated plug 44 is inserted in the recess 41, and the distal portion 48 of the first flange 45 enters first. The plug 44 is pushed by a jig J until the step 45*a* of the first flange 45 engages with the step 41*c*. The outer diameter of the distal portion 48 is greater than the diameter of the small diameter portion 43. Thus, press fitting the distal portion 48 into the small diameter portion 43 causes the plug 44 to be supported by a predetermined contact area.

The first flange 45 of the plug 44 defines a circular separation chamber 49 in the right portion of the recess 41. An annular chamber 50 is defined by the first and second flanges 45, 46 at the left of the separation chamber 49. An outlet passage 51 is formed in the first flange 45 and the cylinder 47 to connect the separation chamber 49 with the annular chamber 50. The outlet passage 51 has an entrance in the distal portion 48 and is coaxial with the separation chamber 49. A transverse bore forms a pair of exits for the outlet passage 51 to the annular chamber 50. The diameter of the separation chamber 49 is greater than the diameter of the entrance to the outlet passage 51.

As illustrated in FIG. 3, an introduction passage 18*a* forms an upstream portion of the discharge passage 18 and connects the discharge chamber 25 with the separation chamber 49. The introduction passage 18*a* is connected to the separation chamber 49 such that, as viewed in the axial direction, the passage 18*a* is tangential to the inner wall 41*b* of the separation chamber 49 as shown in FIG. 3. An outlet passage 18*b*, which is connected to the muffler chamber 17*a*, forms the downstream portion of the discharge passage 18. The outlet passage 18*b* connects the annular chamber 50 with the muffler chamber 17*a*.

Refrigerant gas in the discharge chamber 25 is led to the separation chamber 49 by the introduction passage 18*a*. The gas then rotates along the inner wall 41*b* of the separation chamber 49. The centrifugal force of the gas rotation separates atomized oil from the refrigerant gas. Gas located near the center axis of the separation chamber 49 contains less oil than gas located at the periphery of the chamber 49. The outlet passage 51 and the separation chamber 49 are coaxial, and the diameter of entrance to the outlet passage 51 is smaller than the diameter of the separation chamber 49. Therefore, gas located at the center, which contains little oil, is discharged from the communication passage 50. The gas is then discharged to the external refrigerant circuit via the outlet passage 51, the annular chamber 50, the outlet passage 18*b* and the muffler chamber 17*a*. The pressure in the crank chamber 15 is lower than the discharge pressure, which acts on the separation chamber 49. The gas in the separation chamber 49 is conducted to the crank chamber 15 by the pressure difference to control the compressor displacement. When gas is conducted to the crank chamber 15, the separated oil in the separation chamber 49 is drawn to the crank chamber 15 through the supply passage 31. The oil is then delivered between the pistons 22 and the shoes 23 and between the shoes 23 and the swash plate 20. The oil lubricates and cools the engaging surfaces.

The illustrated embodiment has the following advantages.

(1) The plug 44 is press fitted in the recess 41. In other words, the plug 44 is easily assembled with the compressor by inserting the plug 44 into the recess 41, which significantly shortens the manufacturing time compared to the prior art.

(2) The rear housing 13 and the plug 44 are made of the same material, which have the same coefficient of thermal expansion. Thus, the distal portion 48 of the plug 44 is prevented from being disengaged from the small diameter portion 43 of the recess 41 due to the influence of heat. That is, the plug 44 is firmly fixed in the recess 41 (the rear housing 13) regardless of temperature changes.

(3) The solid lubricant coating is formed on the surface of the plug 44. Particularly, the coating formed on the surfaces 52*a*, 48*a* of the stopper 52 and the distal portion 48 of the first flange 45 allows the plug 44 to be smoothly inserted into the recess 41.

If a liquid lubricant such as oil is applied on the surface of the plug 44, the liquid lubricant would be removed from the surface of the distal portion 48 when the distal portion 48 is pressed into the small diameter portion 43, since the distal portion 48 of the plug 44 and the small diameter portion 43 of the recess 41 are accurately machined. This prevents the plug 44 from being smoothly inserted into the recess 41.

In the illustrated embodiment, the coating between the rear housing 13 (the small diameter portion 43) and the plug 44 (the distal portion 48) is made of a different material than the material of the rear housing 13 and the plug 44. The coating eliminates galling of the plug 44 and the recess 41, which prevents shavings of the rear housing 13 and the plug 44 from being mixed in the oil. Therefore, the supply passage 31 is not clogged with the shavings.

(4) The surface of the plug 44 is roughened prior to forming of the coating 47*a*. This allows the surface of the plug 44 to hold the solid lubricant, thereby strengthening the coating 47*a*.

(5) The surface of the plug 44 is roughened by shot blasting. Compared to a method using chemical substance to roughen the surface of the plug 44, shot blasting allows the roughness to be easily controlled. Also, shot blasting improves the working environment for workers.

(6) The outlet passage 51 opens to the separation chamber 49 and is coaxial with the recess 41. Therefore, the gas located in the center of the rotation is led to the annular chamber 50 by the outlet passage 51. In other words, gas from which oil has been removed by the centrifugal force flows to the annular chamber 50 through the outlet passage 51. This reduces the amount of oil drawn to the annular chamber 50 by the gas flow. That is, the structure reduces the amount of oil discharged to the external refrigerant circuit, which improves the oil recovery efficiency.

(7) The plug 44 includes the first and second flanges 45, 46, which are integrated by the cylinder 47. This structure facilitates the installation of the plug 44 into the recess 41.

(8) The open end 41*a* of the recess 41 is tapered. That is, the diameter of the open end 41*a* increases toward the discharge chamber 25. This allows the plug 44 to be smoothly inserted into the recess 41.

(9) The positioning step 41*c* is formed in the recess 41. The plug 44 is pressed until it contacts the step 41*c*, which forms the separation chamber 49 having a predetermined volume without measuring the pressing distance. Therefore, this construction reduces the variation of the oil separation ability of the separation chamber 49.

(10) The positioning step 41*c* is tapered. This structure allows the distal portion 48 to be smoothly inserted into the small diameter portion 43.

(11) The supply passage 31 controls the displacement of the compressor and also functions as an oil return passage for the oil separating structure. This structure eliminates the necessity for a passage exclusively designed for returning oil, which simplifies the compressor structure.

It should be apparent to those skilled in the art that the present invention may be embodied in many other specific forms without departing from the spirit or scope of the invention. Particularly, it should be understood that the invention may be embodied in the following forms.

The plug 44 may be made of brass or brass alloy. That is, the plug 44 may be made of different type of metal from that of the rear housing 13. Forming the rear housing 13 and the plug 44 with metals of different types prevents galling, which, would occur if the housing 13 and the plug 44 are made of the same type of metal, absent a proper solid lubricant. Compared to iron alloys, the coefficient of thermal expansion of brass and brass alloy is close to that of aluminum alloy. Therefore, the engagement between the recess 41 and the plug 44 is not loosened significantly by temperature changes.

In the preferred embodiment, the rear housing 13 and the plug 44 are made of the same material. That is, the materials used for the rear housing 13 and the plug 44 are of the same type and include the same ratios of components. While using the same type of materials for the rear housing 13 and the plug 44, the components and their ratios may be changed. For example, when using aluminum alloys for the rear housing 13 and the plug 44, one of the rear housing 13 and the plug 44 may be made of an aluminum alloy containing hard silicon particles while forming the other with an aluminum alloy containing no hard silicon particles. Alternatively, the rear housing 13 and the plug 44 may be made of materials containing hard particles. In this case, the ratio of the hard particles to the other components in the materials may be different.

The plug 44 may be made of a synthetic resin, which facilitates forming of the plug 44 and reduces the weight.

The oil separating structure may be constructed such that oil in the refrigerant gas is separated from the gas by inertial separation. In this case, the plug 44 may only have the first flange 45 and the outlet passage 18*b* may be directly connected to the separation chamber 49.

The first flange 45, the second flange 46 and the cylinder 47 may be separately formed and integrated by adhesive or welding to form the plug 44. This simplifies the shape of each component of the plug 44 thereby facilitating the forming of the components. Further, the components are integrated to form the plug 44, which facilitates the installing of the plug 44 into the recess 41.

The discharge chamber 25 may be connected to the crank chamber 15 by the supply passage 31, and the separation chamber 49 may be communicated with the crank chamber 15 by an oil return passage formed separately from the supply passage 31.

The surface of the plug 44 may be roughened by a method other than shot blasting such as liquid honing.

The solution to form the coating 47*a* may be applied to the plug 44 by spraying.

The coating on the plug 44 may be formed by plating such as tin plating.

Therefore, the present examples and embodiments are to be considered as illustrative and not restrictive and the invention is not to be limited to the details given herein, but may be modified within the scope and equivalence of the appended claims.

What is claimed is:

1. A compressor comprising:

a housing;

a compressing mechanism, which is housed by the housing, for compressing refrigerant gas, wherein lubricating oil is mixed in the gas;

a discharge passage permitting refrigerant to flow out of the compressor;

an oil separator for separating the lubricating oil from the gas, the separator including:

a recess;

a plug securely press-fitted in the recess, wherein the plug and the recess form a separation chamber located in the discharge passage, wherein the plug includes an outlet passage leading downstream from the separation chamber, and wherein the refrigerant gas enters the separation chamber, flows along the wall of the separation chamber and exits from the separation chamber, which separates the oil from the gas; and a supply passage connecting the separation chamber to the compressing mechanism to supply lubricant to the compressing mechanism.

2. The compressor according to claim 1, wherein the recess, the discharge passage, and the supply passage are formed in the housing.

3. The compressor according to claim 1, wherein the separation chamber has a circular cross section.

4. The compressor according to claim 1, wherein the outlet passage has an entrance that is smaller in cross section than the separation chamber, and wherein the outlet passsage is coaxial to the separation chamber.

5. The compressor according to claim 3, wherein the refrigerant gas swirls in the separation chamber so that centrifugal force acts on the gas, separating the oil from the gas, and wherein the refrigerant gas exits from the separation chamber near the center of the separation chamber.

6. The compressor according to claim 2, wherein the housing and the plug are formed of the same type of metal.

7. The compressor according to claim 2 wherein the housing and the plug are formed from metal materials of different types.

8. The compressor according to claim 6, wherein the housing and the plug are formed from aluminum or aluminum alloys.

9. The compressor according to claim 7 wherein one of the housing and the plug is formed from aluminum or aluminum alloys, and the other is formed from brass.

10. The compressor according to claim 6 wherein a coating of a solid lubricant is applied on at least one of the outer surface of the plug and a surface of the recess such that the solid lubricant exists between the recess and the plug.

11. The compressor according to claim 10 wherein the surface to which the solid lubricant is applied has been prepared for the solid lubricant by being roughened.

12. The compressor according to claim 11 wherein the surface to which the lubricant is applied has indentations produced by shot blasting.

13. A compressor comprising:

a housing;

a compressing mechanism, which is housed by the housing, for compressing refrigerant gas, wherein lubricating oil is mixed in the gas;

a discharge passage permitting refrigerant to flow out of the compressor;

an oil separator for separating the lubricating oil from the gas, the separator including:

a recess located within the compressor; and a plug securely fastened to a wall of the recess such that the plug is fixed against rotation about its axis, wherein the plug arid the recess form a separation chamber located in the discharge passage, and the plug includes an outlet passage leading downstream from the separation chamber, and wherein the refrigerant gas enters the separation chamber, flows along the wall of the separation chamber and exits from the separation chamber, which separates the oil from the gas; and a supply passage connecting the separation chamber to the compressing mechanism to supply lubricant to the compressing mechanism.

14. The compressor according to claim 13, wherein the recess, the discharge passage, and the supply passage are formed in the housing.

15. The compressor according to claim 13, wherein the separation chamber has a circular cross section.

16. The compressor according to claim 13, wherein the outlet passage has an entrance that is smaller in cross section than the separation chamber, and wherein the outlet passage is coaxial to the separation chamber.

17. The compressor according to claim 15, wherein the refrigerant gas swirls in the separation chamber so that centrifugal force acts on the gas, separating the oil from the gas, and wherein the refrigerant gas exits from the separation chamber near the center of the separation chamber.

18. The compressor according to claim 14, wherein the housing and the plug are formed of the same type of metal.

19. The compressor according to claim 14, wherein the housing and the plug are formed from metal materials of different types.

20. The compressor according to claim 18, wherein the housing and the plug are formed from aluminum or aluminum alloys.

21. The compressor according to claim 19, wherein one of the housing and the plug is formed from aluminum or aluminum alloys, and the other is formed from brass.

22. The compressor according to claim 18, wherein a coating of a solid lubricant is applied on at least one of the outer surface of the plug and the wall of the recess such that the solid lubricant exists between the recess and the plug.

23. The compressor according to claim 22, wherein the surface to which the lubricant is applied is roughened.

24. The compressor according to claim 23 wherein the surface to which the lubricant is applied has indentations produced by shot blasting.

25. A compressor comprising:

a housing;

a compressing mechanism, which is housed by the housing, for compressing refrigerant gas, wherein lubricating oil is mixed in the gas;

a discharge passage permitting refrigerant to flow out of the compressor;

an oil separator for separating the lubricating oil from the gas, the separator including:

a recess;

a plug securely press-fitted in the recess to prevent the plug from rotating about its axis, at least a portion of the outer surface of the plug being tapered, wherein the recess and the plug form a separation chamber located in the discharge passage, the plug having a centrally formed outlet passage leading downstream from the separation chamber, and wherein the refrigerant gas enters the separation chamber, flows along the wall of the separation chamber and exits from the separation chamber, which separates the oil from the gas; and a supply passage connecting the separation chamber to the compressing mechanism to supply lubricant to the compressing mechanism.

26. The compressor of claim 25, wherein the separation chamber has a circular cross section.

27. The compressor of claim 25, wherein the outlet passage has an entrance that is smaller in cross section than the separation chamber, and wherein the outlet passage is coaxial to the separation chamber.

28. The compressor according to claim 26, wherein the refrigerant gas swirls in the separation chamber so that centrifugal force acts on the gas, separating the oil from the gas, and wherein the refrigerant gas exits from the separation chamber near the center of the separation chamber.

29. The compressor of claim 25, wherein the diameter of the plug is larger than that of the recess prior to press-fitting the plug into the recess.

* * * * *

UNITED STATES PATENT AND TRADEMARK OFFICE

CERTIFICATE OF CORRECTION

PATENT NO. : 6,179,578 B1
DATED : January 30, 2001
INVENTOR(S) : Hiroaki Kayukawa et al.

It is certified that error appears in the above-identified patent and that said Letters Patent is hereby corrected as shown below:

Column 9,
Line 37, please change “the plug arid the recess” to -- the plug and the recess --;

Signed and Sealed this

Twenty-fourth Day of December, 2002

JAMES E. ROGAN
*Director of the United States Patent and Trademark Office*